US009858944B1

(12) United States Patent
Malik et al.

(10) Patent No.: US 9,858,944 B1
(45) Date of Patent: Jan. 2, 2018

(54) APPARATUS AND METHOD FOR LINEAR AND NONLINEAR ACOUSTIC ECHO CONTROL USING ADDITIONAL MICROPHONES COLLOCATED WITH A LOUDSPEAKER

(71) Applicant: Apple Inc., Cupertino, CA (US)

(72) Inventors: Sarmad Aziz Malik, Cupertino, CA (US); Arvindh Krishnaswamy, Palo Alto, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 15/206,110

(22) Filed: Jul. 8, 2016

(51) Int. Cl.

| | |
|---|---|
| ***G10L 21/0364*** | (2013.01) |
| ***G10L 21/0264*** | (2013.01) |
| ***G10L 25/21*** | (2013.01) |
| ***G10L 21/0208*** | (2013.01) |
| ***G10L 21/0216*** | (2013.01) |

(52) U.S. Cl.
CPC ..... *G10L 21/0364* (2013.01); *G10L 21/0264* (2013.01); *G10L 25/21* (2013.01); *G10L 2021/02082* (2013.01); *G10L 2021/02166* (2013.01)

(58) Field of Classification Search
CPC . G10L 21/0364; G10L 21/0264; G10L 25/21; G10L 2021/02082; G10L 2021/02166
See application file for complete search history.

(56) References Cited

U.S. PATENT DOCUMENTS

| | | | | |
|---|---|---|---|---|
| 8,498,423 | B2 | 7/2013 | Thaden et al. | |
| 8,549,197 | B2 | 10/2013 | Hall et al. | |
| 8,682,250 | B2 | 3/2014 | Magrath et al. | |
| 2013/0315402 | A1* | 11/2013 | Visser | G10L 19/00 381/18 |
| 2014/0274218 | A1 | 9/2014 | Kadiwala et al. | |
| 2015/0092065 | A1 | 4/2015 | Radhakrishnan et al. | |
| 2015/0172811 | A1* | 6/2015 | Sassi | H04R 3/002 381/71.1 |
| 2016/0035366 | A1* | 2/2016 | Matsuo | G10L 21/02 381/66 |
| 2016/0205263 | A1* | 7/2016 | Liu | H04M 9/082 455/570 |

* cited by examiner

*Primary Examiner* — Sonia Gay

(74) *Attorney, Agent, or Firm* — Blakely Sokoloff Taylor & Zafman LLP

(57) ABSTRACT

Apparatus for linear and nonlinear acoustic echo control includes loudspeaker, first, second, and third microphone, beamformer, and first echo canceller. The loudspeaker outputs a loudspeaker signal that includes reference signal. The first microphone and the second microphone are collocated with the loudspeaker, receive at least one of: a near-end speaker signal from a near-end speaker and the loudspeaker signal, and generate first and second microphone uplink signals, respectively. The third microphone receives the near-end speaker signal and generates a third microphone uplink signal. The beamformer receives the first and second microphone uplink signals, directs a beam towards the loudspeaker and drives a null towards the near-end speaker, and generates a beamformer output. The first echo canceler receives the third microphone uplink signal and the beamformer output, and cancels echoes in the third microphone uplink signal based on the beamformer output to generate an echo cancelled signal. Other embodiments are described.

14 Claims, 7 Drawing Sheets

APPARATUS AND METHOD FOR LINEAR AND NONLINEAR ACOUSTIC ECHO CONTROL USING ADDITIONAL MICROPHONES COLLOCATED WITH A LOUDSPEAKER

FIELD

Embodiments of the invention relate generally to an apparatus and method for linear and nonlinear acoustic echo control using additional microphones collocated with a loudspeaker.

BACKGROUND

Currently, a number of consumer electronic devices are adapted to receive speech from a near-end talker (or environment) via microphone ports, transmit this signal to a far-end device, and concurrently output audio signals, including a far-end talker, that are received from a far-end device. While the typical example is a portable telecommunications device (mobile telephone), with the advent of Voice over IP (VoIP), desktop computers, laptop computers and tablet computers may also be used to perform voice communications.

In these full-duplex communication devices, where both parties can communicate to the other simultaneously, the downlink signal that is output from the loudspeaker may be captured/acquired by the microphone and get fed back to the far-end device as echo. This is due to the natural coupling between the microphone and loudspeaker, e.g. the coupling is inherent due to the proximity of the microphones to the loudspeakers in these devices, the use of loud playback levels in the loudspeaker, and the sensitive microphones in these devices. This echo, which can occur concurrently with the desired near-end speech, often renders the user's speech difficult to understand, and even unintelligible over a course of such feedback loops through multiple near-end/far-end playback and acquisition cycles. Echo, thus, degrades the quality of the voice communication.

SUMMARY

Generally, the invention relates to an apparatus and method for linear and nonlinear acoustic echo control using additional microphones collocated with a loudspeaker. When the loudspeaker is excited with a reference signal, along with linear echo, nonlinear phenomena are inevitably injected into the apparatus (or electronic device) and thus cause unwanted linear and nonlinear echoes. Using two microphones that are collocated with the loudspeaker, a beamformer may direct a beam towards the loudspeaker and simultaneously drive a null towards the near-end speaker (e.g. the local voice source in hands-free mode). The beamformer output, which contains both the linear and nonlinear components of the loudspeaker, may then be used to drive the echo cancelation as well as the residual echo suppression.

In one embodiment, an apparatus for linear and nonlinear acoustic echo control comprises a loudspeaker, a first, second, and third microphone, a beamformer, and a first echo canceller. The loudspeaker outputs a loudspeaker signal that is a result of excitation via the reference signal. The first microphone and the second microphone are collocated with the loudspeaker, receive at least one of: a near-end speaker signal from a near-end speaker and the loudspeaker signal, and generate first and second microphone uplink signals, respectively. The third microphone receives the near-end speaker signal, the echo signal as well to a lesser extent, and generates a third microphone uplink signal. The beamformer receives the first and second microphone uplink signals, directs a beam towards the loudspeaker and drives a null towards the near-end speaker, and generates a beamformer output. The first echo canceler receives the third microphone uplink signal and the beamformer output, and cancels echoes in the third microphone uplink signal based on the beamformer output to generate an echo cancelled signal.

In one embodiment, an apparatus for linear and nonlinear acoustic echo control comprises a loudspeaker, a first, second, and third microphone, a beamformer, a first and a second echo canceller, and a residual echo suppressor. The loudspeaker outputs a loudspeaker signal that is a result of excitation due to the reference signal. The first microphone and the second microphone that are collocated with the loudspeaker receive at least one of: a near-end speaker signal from a near-end speaker and the loudspeaker signal, and generate first and second microphone uplink signals, respectively. The third microphone receives the near-end speaker signal, as well as the echo signals but to a lesser extent as compared to the bottom microphones, and generates a third microphone uplink signal. The beamformer receives the first and second microphone uplink signals, directs a beam towards the loudspeaker and drives a null towards the near-end speaker and generates a beamformer output. The first echo canceller receives the third microphone uplink signal and the beamformer output, and generates a first echo estimate. The second echo canceller receives the loudspeaker signal and the third uplink microphone signal, and generates a second echo estimate and cancels echoes in the third microphone uplink signal based on the loudspeaker signal to generate an echo cancelled signal. The residual echo suppressor suppresses residual echo in the echo cancelled signal based on the differences and similarities between the first and second echo estimates.

In one embodiment, a method for linear and nonlinear acoustic echo control starts with a first microphone and a second microphone that are collocated with a loudspeaker receiving at least one of: a near-end speaker signal from a near-end speaker and a loudspeaker signal. The loudspeaker signal is output by the loudspeaker and is driven by a reference signal. The first and second microphones generate first and second microphone uplink signals, respectively. A third microphone then receives the near-end speaker signal, and the echo signals as well but to a lesser degree, and generates a third microphone uplink signal. A beamformer then receives the first and second microphone uplink signals and generates a beamformer output. The beamformer directs a beam towards the loudspeaker and drives a null towards the near-end speaker. A first echo canceller receives the third microphone uplink signal and the beamformer output and generates a first echo estimate. A second echo canceller then receives the loudspeaker signal and the third uplink microphone signal and generates a second echo estimate and an echo cancelled signal. The second echo canceller cancel echoes in the third microphone uplink signal based on the loudspeaker signal to generate the echo cancelled signal. A residual echo suppressor suppresses residual echo in the echo cancelled signal based on the first and second echo estimates.

The above summary does not include an exhaustive list of all aspects of the present invention. It is contemplated that the invention includes all systems, apparatuses and methods that can be practiced from all suitable combinations of the various aspects summarized above, as well as those disclosed in the Detailed Description below and particularly pointed out in the claims filed with the application. Such combinations may have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one. In the drawings.

DETAILED DESCRIPTION

In the following description, numerous specific details are set forth. However, it is understood that embodiments of the invention may be practiced without these specific details. In other instances, well-known circuits, structures, and techniques have not been shown to avoid obscuring the understanding of this description.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

Figure 1:
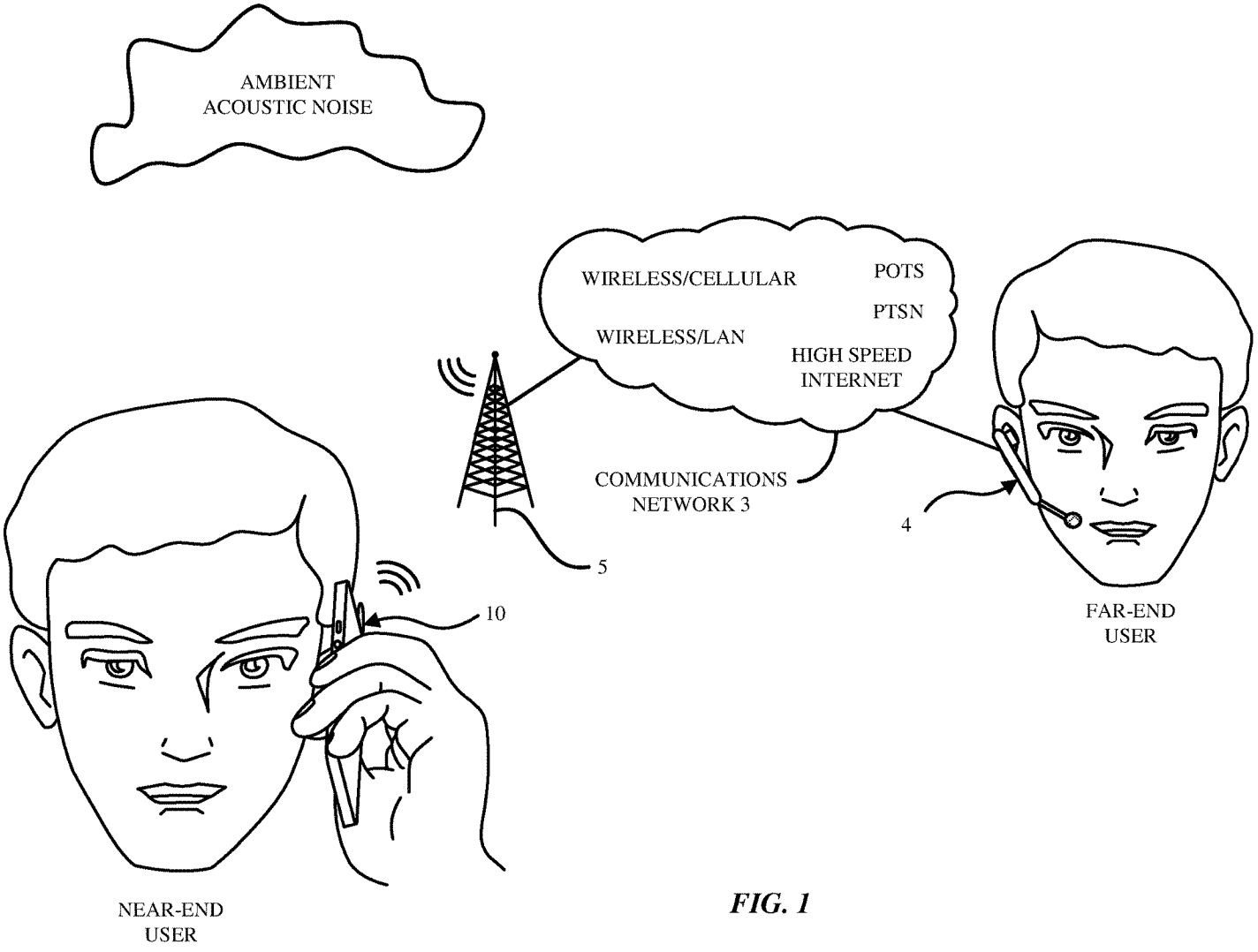
FIG. 1 depicts near-end user and a far-end user using an exemplary electronic device in which an embodiment of the invention may be implemented.

FIG. 1 depicts near-end user and a far-end user using an exemplary electronic device in which an embodiment of the invention may be implemented. The electronic device 10 may be a mobile communications handset device such as a smart phone or a multi-function cellular phone. The sound quality improvement techniques using beamforming, double talk detection and linear and nonlinear acoustic echo cancellation described herein can be implemented in such a user audio device, to improve the quality of the near-end audio signal. In the embodiment in FIG. 1, the near-end user is in the process of a call with a far-end user who is using another communications device 4. The term "call" is used here generically to refer to any two-way real-time or live audio communications session with a far-end user (including a video call which allows simultaneous audio). The electronic device 10 communicates with a wireless base station 5 in the initial segment of its communication link. The call, however, may be conducted through multiple segments over one or more communication networks 3, e.g. a wireless cellular network, a wireless local area network, a wide area network such as the Internet, and a public switch telephone network such as the plain old telephone system (POTS). The far-end user need not be using a mobile device, but instead may be using a landline based POTS or Internet telephony station.

Figure 2:
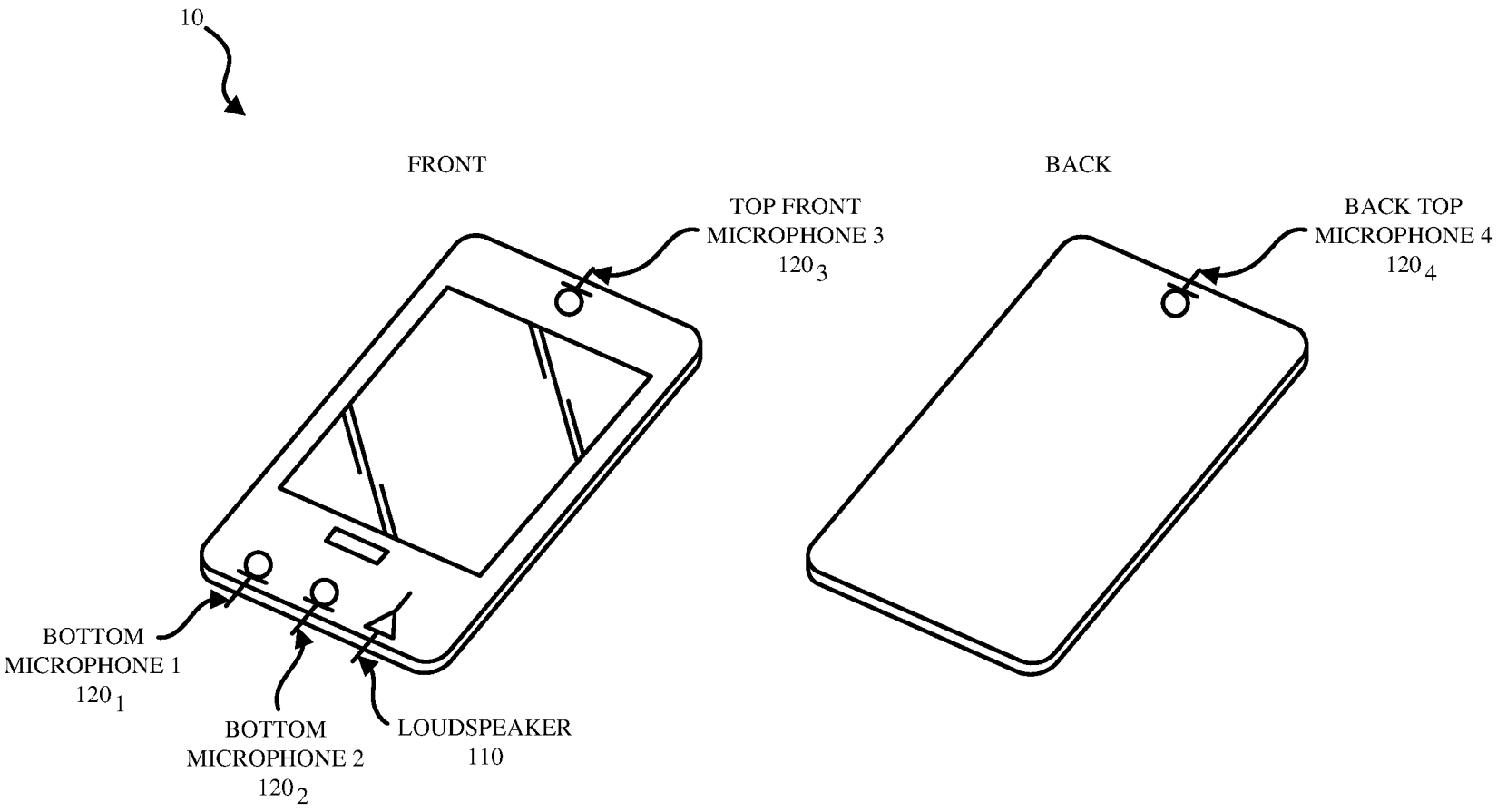
FIG. 2 depicts an exemplary electronic device in which an embodiment of the invention may be implemented.

FIG. 2 depicts an exemplary electronic device 10 in which an embodiment of the invention may be implemented. As shown in FIG. 2, the electronic device 10 may include a housing having a bezel to hold a display screen on the front face of the device. The display screen may also include a touch screen. The electronic device 10 may also include one or more physical buttons and/or virtual buttons (on the touch screen). As shown in FIG. 2, the electronic device 10 may also include a plurality of microphones $\mathbf{120}_1$-$\mathbf{120}_n$ (n>1) and a loudspeaker 110. The microphones $\mathbf{120}_1$-$\mathbf{120}_n$ (n>1) may be air interface sound pickup devices that convert sound into an electrical signal.

The first bottom microphone $\mathbf{120}_1$ and the second bottom microphone $\mathbf{120}_2$ are collocated with the loudspeaker 110 at the bottom of the electronic device 10. In some embodiments, the second bottom microphone $\mathbf{120}_2$ is closer to the loudspeaker 110 than the first bottom microphone $\mathbf{120}_1$. In FIG. 2, a top front microphone $\mathbf{120}_3$ is located on the front face of the electronic device 10 at the top of the electronic device 10. In one embodiment, a top back microphone $\mathbf{120}_4$ may be located on the back face of the electronic device 10 at the top of the electronic device 10.

Electronic device 10 may also include input-output components such as ports and jacks. For example, openings (not shown) may form microphone ports and speaker ports (in use when the speaker phone mode is enabled or for a telephone receiver that is placed adjacent to the user's ear during a call). The microphones $\mathbf{120}_1$-$\mathbf{120}_n$ and loudspeaker 110 may be coupled to the ports accordingly.

Figure 3:
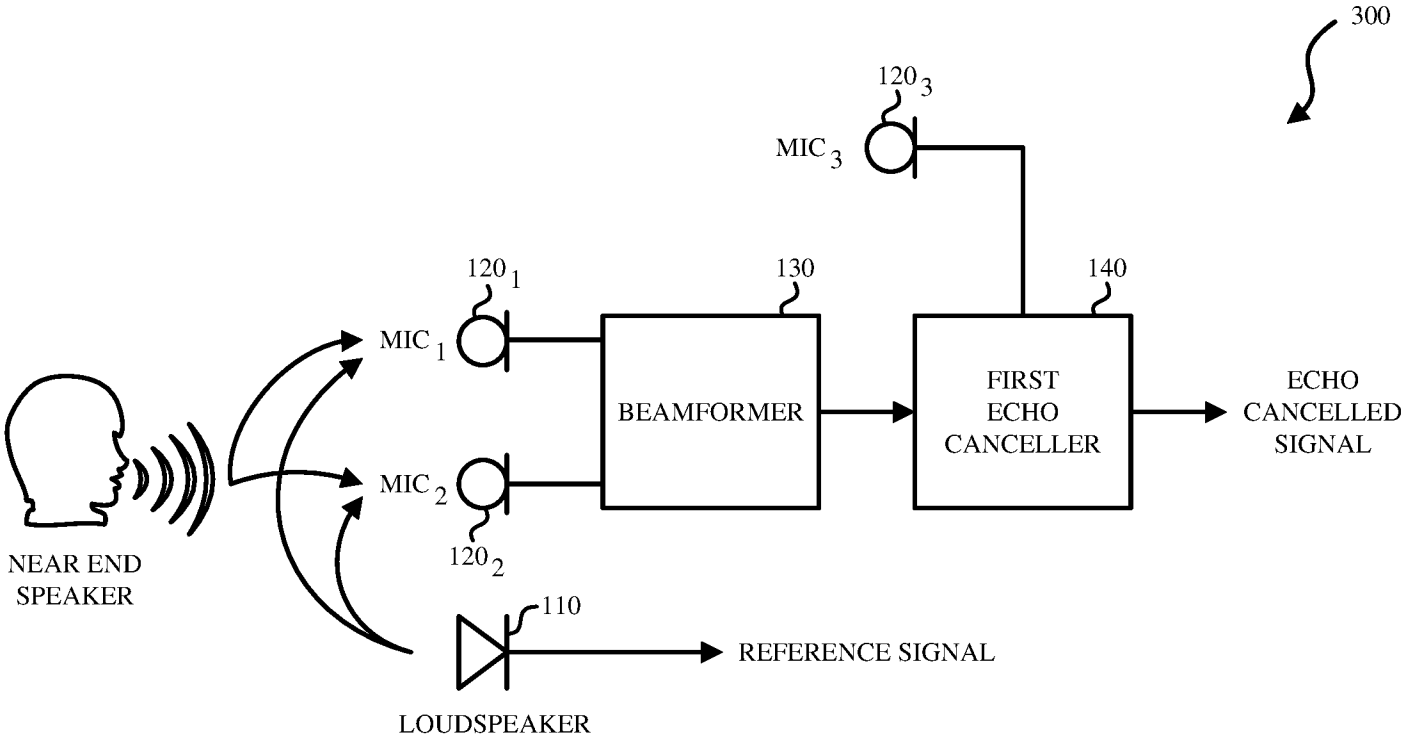
FIG. 3 is a block diagram of an apparatus for linear and nonlinear acoustic echo control using additional microphones collocated with a loudspeaker according to an embodiment of the invention.

FIG. 3 is a block diagram of an apparatus 300 for linear and nonlinear acoustic echo control using additional microphones collocated with a loudspeaker according to an embodiment of the invention. In FIG. 3, the apparatus (e.g., electronic device 10) may include a loudspeaker 110 to output a loudspeaker signal that includes a reference signal. The reference signal may be a standard reference signal. In some embodiments, the loudspeaker signal may also include a downlink audio signal from a far-end speaker. Thus, the loudspeaker 110 may be driven by an output downlink signal that includes the far-end acoustic signal components. The first bottom microphone $\mathbf{120}_1$ and the second bottom microphone $\mathbf{120}_2$ are collocated with the loudspeaker 110. The first and second bottom microphones $\mathbf{120}_1$, $\mathbf{120}_2$ may receive at least one of: a near-end speaker signal from a near-end speaker and the loudspeaker signal. The first and second bottom microphones $\mathbf{120}_1$, $\mathbf{120}_2$ may also generate first and second microphone uplink signals, respectively.

In some embodiments, the second bottom microphone $\mathbf{120}_2$ is closer to the loudspeaker 110 than the first bottom microphone $\mathbf{120}_1$. The first bottom microphone $\mathbf{120}_1$ may capture the linear as well as nonlinear echo. However, due to the proximity of the second bottom microphone $120_2$ to the loudspeaker 110, the second bottom microphone $120_2$ may be able to capture the maximum amount of loudspeaker nonlinearity. A beamformer 130 receives the first and second microphone uplink signals. The beamformer 130 directs a beam towards the loudspeaker 110 and drives a null towards the near-end speaker. In some embodiments, the null may be towards the near-end speaker that is using the hands-free mode (e.g., speaker mode) of the electronic device 10. Accordingly, the beamformer 130 captures linear and nonlinear components in the loudspeaker signal and removes interference, i.e., the near-end speaker. For example, the beamformer 130 may remove from the linear and nonlinear components in the loudspeaker signal the interference from the near-end speaker. In this embodiment, the beamformer 130 can output the echo signal comprising linear and nonlinear echoes at a high echo-to-noise ratio even in the presence of a near-end speaker. The beamformer 130 thus generates a beamformer output.

In FIG. 3, the top front microphone $120_3$ is illustrated to receive the near-end speaker signal and to generate a third microphone uplink signal. The top front microphone $120_3$ may also capture the echo signals due to coupling between the loudspeaker 110 and the top front microphone $120_3$ itself. This coupling, however, is considerably less than the coupling between the bottom microphones $120_1$, $120_2$ and the loudspeaker 110. However, it is understood that the top back microphone $120_4$ may also be used in lieu of or in addition to the top front microphone $120_3$ in FIG. 3. As shown in FIG. 3, the top front microphone $120_3$ is coupled to a first echo canceller 140. In some embodiments, the first echo canceller 140 is a linear echo canceller. For example, the first echo canceller 140 may be an adaptive filter that linearly estimate echo to generate a linear echo estimate and to generate an echo cancelled signal using the linear echo estimate. In FIG. 3, the first echo canceller 140 receives the third microphone uplink signal and the beamformer output from the beamformer 130. In one embodiment, the first echo canceller 140 may cancel echoes in the third microphone uplink signal based on the beamformer output to generate an echo cancelled signal. In some embodiments, the first echo canceller 140 may cancel echoes in the third microphone uplink signal by (i) generating a linear echo estimate based on the beamformer output and (ii) subtracting the linear echo estimate from the third microphone uplink signal. Further, the beamformer output contains nonlinear components since the bottom microphones $120_1$, $120_2$ are collocated with the loudspeaker 110. The nonlinear components in the beamformer output will enable nonlinear echo cancellation at higher far-end signal volumes.

Figure 4:
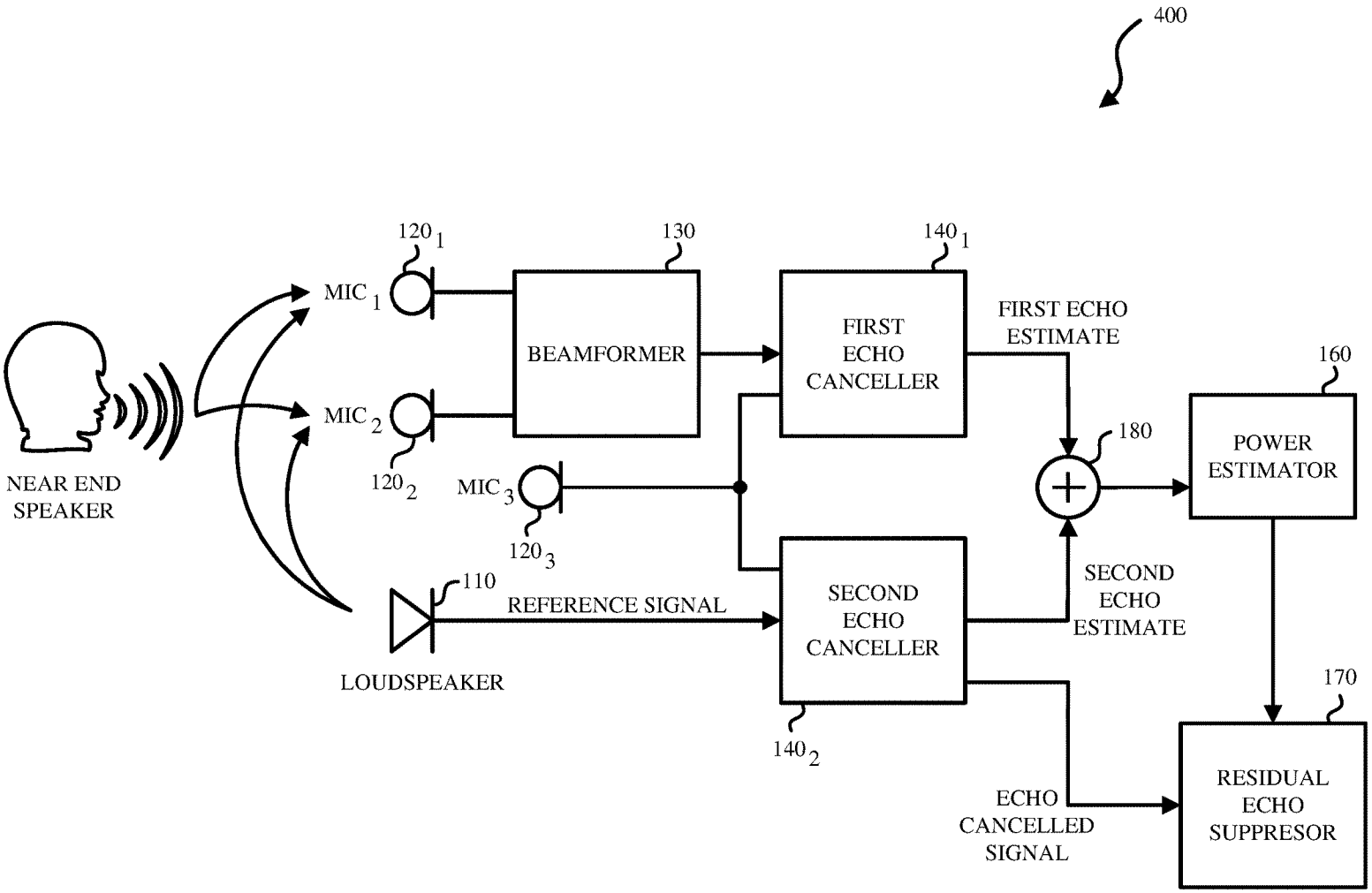
FIG. 4 is a block diagram of an apparatus for linear and nonlinear acoustic echo control using additional microphones collocated with a loudspeaker according to an embodiment of the invention.

FIG. 4 is a block diagram of an apparatus 400 for linear and nonlinear acoustic echo control using additional microphones collocated with a loudspeaker according to an embodiment of the invention. Similar to the apparatus 300, in this embodiment, the apparatus 400 (e.g., electronic device 10) may include a loudspeaker 110 to output a loudspeaker signal that includes a reference signal. The reference signal may be a standard reference signal. In some embodiments, the loudspeaker signal may also include a downlink audio signal from a far-end speaker. The first bottom microphone $120_1$ and the second bottom microphone $120_2$ are collocated with the loudspeaker 110. The first and second bottom microphones $120_1$, $120_2$ may receive at least one of: a near-end speaker signal from a near-end speaker and the loudspeaker signal. The first and second bottom microphones $120_1$, $120_2$ may also generate first and second microphone uplink signals, respectively.

In some embodiments, the second bottom microphone $120_2$ is closer to the loudspeaker 110 than the first bottom microphone $120_1$. The first bottom microphone $120_1$ may capture the linear as well as nonlinear echo. However, due to the proximity of the second bottom microphone $120_2$ to the loudspeaker 110, the second bottom microphone $120_2$ may be able to capture the maximum amount of loudspeaker nonlinearity. A beamformer 130 receives the first and second microphone uplink signals. The beamformer 130 directs a beam towards the loudspeaker 110 and drives a null towards the near-end speaker. In some embodiments, the null may be towards the near-end speaker that is using the hands-free mode (e.g., speaker mode) of the electronic device 10. Accordingly, the beamformer 110 captures linear and nonlinear components in the loudspeaker signal and removes interference, which in this case is the near-end speaker. In this embodiment, the beamformer 130 can output the echo signal comprising linear and nonlinear echoes at a high echo-to-noise ratio even in the presence of a near-end speaker. The beamformer 130 thus generates a beamformer output.

In contrast to the embodiment in FIG. 3, the apparatus 400 in FIG. 4 includes a first echo canceller $140_1$ and a second echo canceller $140_2$. In FIG. 4, the top front microphone $120_3$ is illustrated to receive the near-end speaker signal and the echo signal and to generate a third microphone uplink signal which is transmitted to both the first and the second echo cancellers $140_1$, $140_2$. As shown in FIG. 4, the top front microphone $120_3$ is coupled to the first and the second echo cancellers $140_1$, $140_2$. However, it is understood that the top back microphone $120_4$ may also be used in lieu of or in addition to the top front microphone $120_3$ in FIG. 4.

In some embodiments, the first and second echo cancellers $140_1$, $140_2$ are linear echo cancellers. For example, the first and second echo cancellers $140_1$, $140_2$ may be adaptive filters that linearly estimate echo to generate linear echo estimates, respectively, and to generate echo cancelled signals using the linear echo estimates, respectively. The first echo canceller $140_1$ receives the third microphone uplink signal and the beamformer output from the beamformer 130 and generates a first echo estimate. The second echo canceller $140_2$ receives the loudspeaker signal from the loudspeaker 110 and the third uplink microphone signal from the top front microphone $120_3$ and generates a second echo estimate. The second echo canceller $140_2$ may also cancel echoes in the third microphone uplink signal based on the loudspeaker signal to generate an echo cancelled signal. In some embodiments, the second echo canceller $140_2$ may cancel echoes in the third microphone uplink signal by subtracting the second linear echo estimate from the third microphone uplink signal.

A combiner 180 receives and combines the first and second echo estimates. In some embodiments, the combination of the first and second estimates is obtained by subtracting the second echo estimate from the first echo estimate. A power estimator 160 then receives the combined first and second estimates and generates a power estimator output that includes estimates for a residual linear echo power and a nonlinear echo power in single and double talk situations. In some embodiments, the power estimator 160 generates the power estimator output by calculating a power spectral density based on the first and second estimates.

A residual echo suppressor 170 receives the power estimator output from the power estimator 170 and the echo cancelled signal from the second echo canceller $140_2$. The residual echo suppressor 170 suppresses residual echo in the echo cancelled signal based on the first and second echo estimates. In some embodiments, the residual echo suppressor 170 suppresses residual echo in the echo cancelled signal based on the power estimator output. Accordingly, the residual echo suppressor 170 generates a clean near-end speaker signal.

In this embodiment, the beamformer output aids in the operation of the residual echo suppressor 170. Due to the first and second microphones $\mathbf{120}_1$, $\mathbf{120}_2$ being collocated with the loudspeaker 110, the beamformer output includes an echo signal that contains significant amounts of nonlinear components at a relatively higher echo to local (or near-end speaker) voice ratio compared to the top front microphone $\mathbf{120}_3$ or the top back microphone $\mathbf{120}_4$. In some embodiments, using a gradient-based adaptive scheme, the beamformer output can be mapped onto one of the top front microphone $\mathbf{120}_3$ or the top back microphone $\mathbf{120}_4$, or onto the residual echo signals originating from the top front microphone $\mathbf{120}_3$ or the top back microphone $\mathbf{120}_4$. This mapping will phase align and isolate components that are highly correlated with the top front microphone $\mathbf{120}_3$ or the top back microphone $\mathbf{120}_4$ signals. The mapped signals can then be used to estimate residual linear and nonlinear echo powers in double talk to aid the residual echo suppressor 170.

Moreover, the following embodiments of the invention may be described as a process, which is usually depicted as a flowchart, a flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed. A process may correspond to a method, a procedure, etc.

Figure 5A:
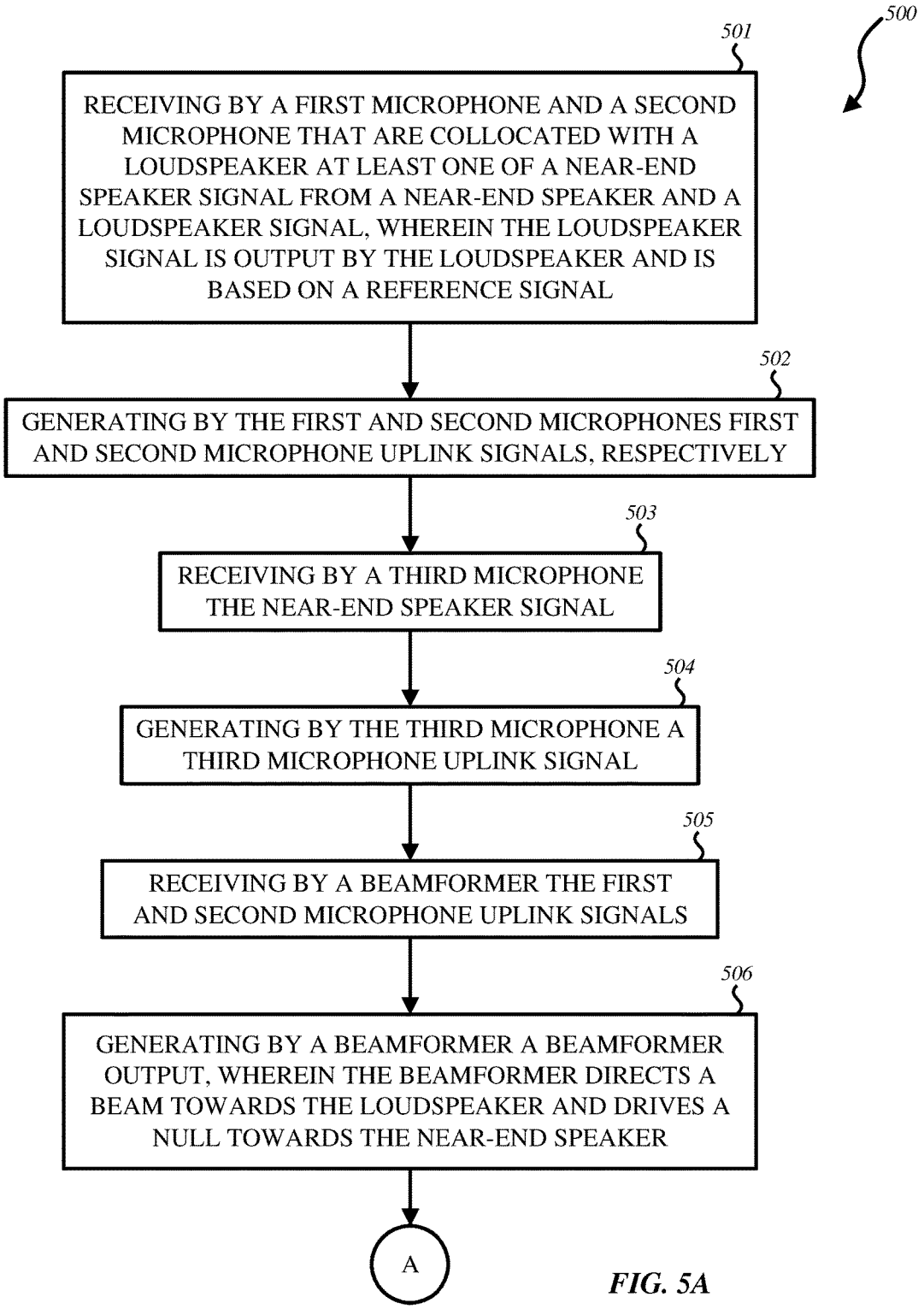
FIGS. 5A-5B illustrates a flow diagram of an example method for linear and nonlinear acoustic echo control using additional microphones collocated with a loudspeaker according to an embodiment of the invention.
Figure 5B:
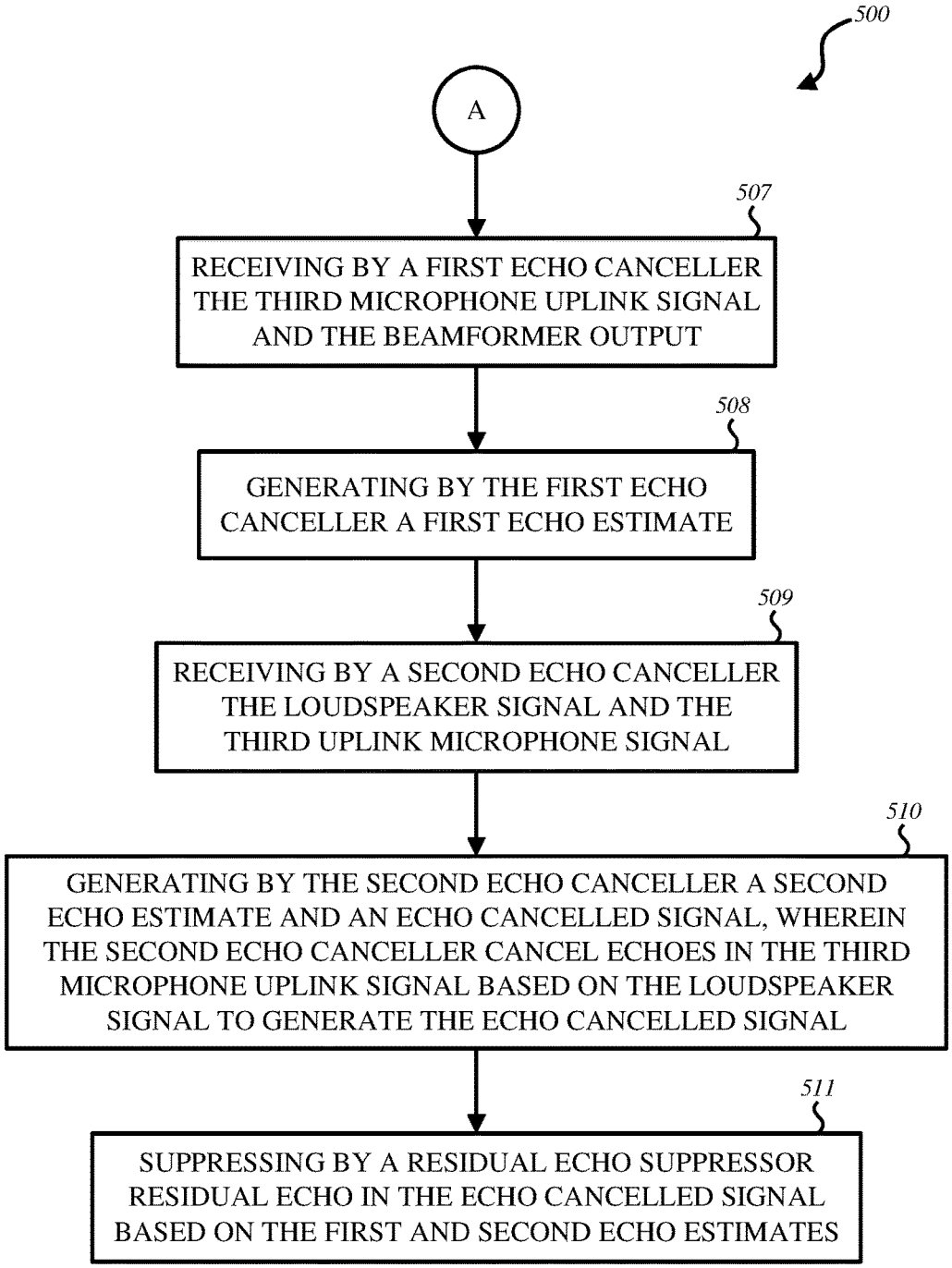

FIGS. 5A-5B illustrate a flow diagram of an example method 500 for linear and nonlinear acoustic echo control using additional microphones collocated with a loudspeaker according to an embodiment of the invention. Method 500 starts with a first microphone and a second microphone that are collocated with a loudspeaker receiving at least one of: a near-end speaker signal from a near-end speaker and a loudspeaker signal (Block 501). The loudspeaker signal is output by the loudspeaker and includes a reference signal. In some embodiments, the second microphone is closer to the loudspeaker than the first microphone. In some embodiments, the first and second microphones are located at a bottom of an electronic device.

At Block 502, the first and second microphones generate first and second microphone uplink signals, respectively. At Block 503, a third microphone receives the near-end speaker signal and at Block 504, generates a third microphone uplink signal. This third microphone signal also receives linear and nonlinear echo signals, but the relative strengths of these echo signals are significantly lower as compared to the two bottom microphones. In one embodiment, the third microphone is located at a top area of a front face of the apparatus. In another embodiment, the third microphone is located at a top area of a back face of the apparatus.

At Block 505, a beamformer receives the first and second microphone uplink signals and at Block 506, generates a beamformer output. The beamformer directs a beam towards the loudspeaker and drives a null towards the near-end speaker. The beamformer captures linear and nonlinear components in the loudspeaker signal and removes interference which is in the form the near-end speaker.

At Block 507, a first echo canceller receives the third microphone uplink signal and the beamformer output and at Block 508, generates a first echo estimate. At Block 509, a second echo canceller receives the loudspeaker signal and the third uplink microphone signal and at Block 510, generates a second echo estimate and an echo cancelled signal. The second echo canceller may cancel echoes in the third microphone uplink signal based on the loudspeaker signal to generate the echo cancelled signal. At Block 511, a residual echo suppressor suppresses residual echo in the echo cancelled signal based on the first and second echo estimates.

In some embodiments, a power estimator receives a combined echo estimate signal that is a combination of the first and the second echo estimates, estimates a residual linear echo power and a nonlinear echo power in double and single talk, and generates a power estimator output that includes estimates of the residual linear echo power and the nonlinear echo power in double and single talk. In this embodiment, the residual echo suppressor suppresses residual echo in the echo cancelled signal based on the power estimator output.

Figure 6:
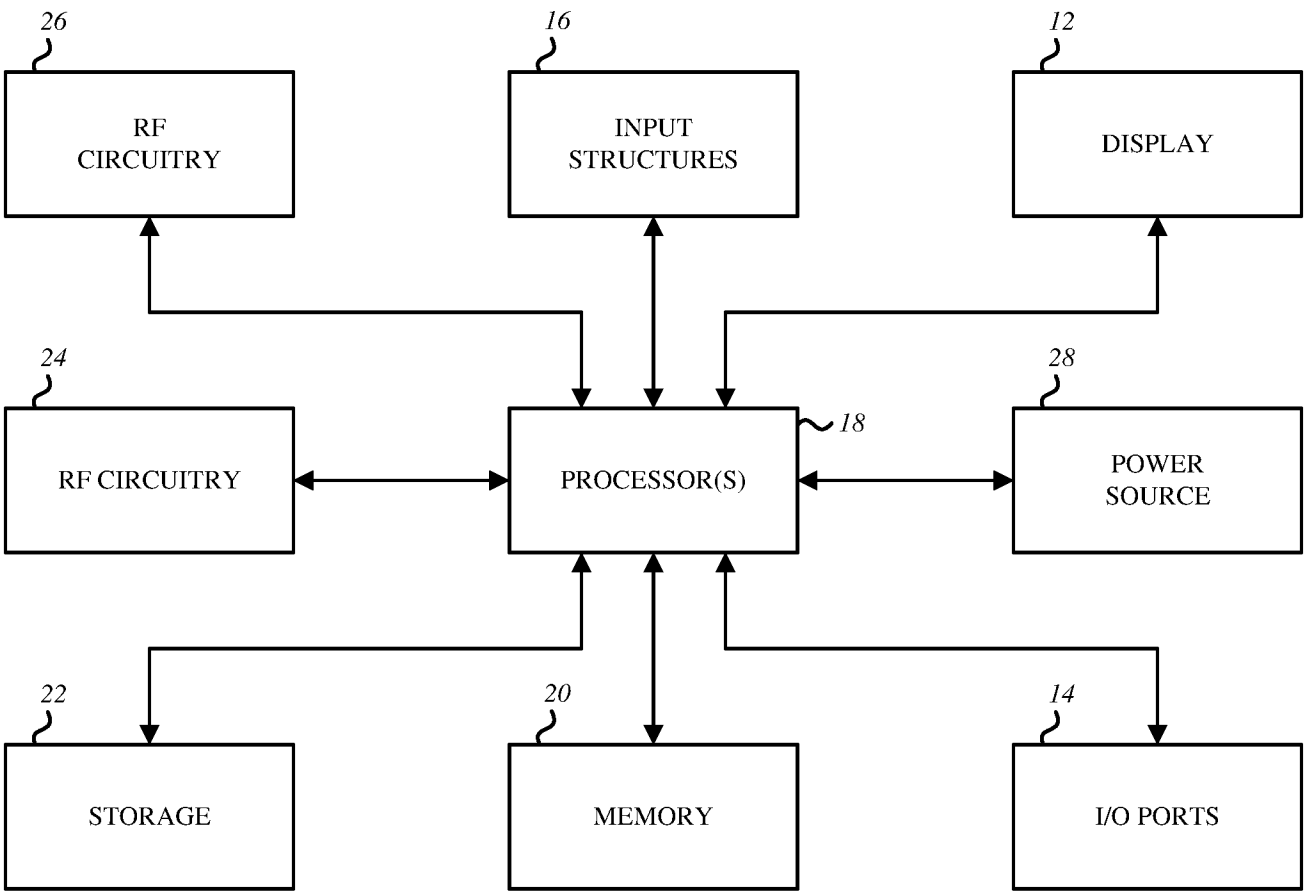
FIG. 6 is a block diagram of exemplary components of an electronic device for linear and nonlinear acoustic echo control using additional microphones collocated with a loudspeaker in accordance with aspects of the present disclosure.

A general description of suitable electronic devices for performing these functions is provided below with respect to FIG. 6. Specifically, FIG. 6 is a block diagram depicting various components that may be present in electronic devices suitable for use with the present techniques. The electronic device may be in the form of a computer, a handheld portable electronic device, and/or a computing device having a tablet-style form factor. These types of electronic devices, as well as other electronic devices providing comparable speech recognition capabilities may be used in conjunction with the present techniques.

Keeping the above points in mind, FIG. 6 is a block diagram illustrating components that may be present in one such electronic device 10, and which may allow the device 10 to function in accordance with the techniques discussed herein. The various functional blocks shown in FIG. 6 may include hardware elements (including circuitry), software elements (including computer code stored on a computer-readable medium, such as a hard drive or system memory), or a combination of both hardware and software elements. It should be noted that FIG. 6 is merely one example of a particular implementation and is merely intended to illustrate the types of components that may be present in the electronic device 10. For example, in the illustrated embodiment, these components may include a display 16, input/output (I/O) ports 14, input structures 12, one or more processors 18, memory device(s) 20, non-volatile storage 22, expansion card(s) 24, RF circuitry 26, and power source 28.

In the embodiment of the electronic device 10 in the form of a computer, the embodiment include computers that are generally portable (such as laptop, notebook, tablet, and handheld computers), as well as computers that are generally used in one place (such as conventional desktop computers, workstations, and servers).

The electronic device 10 may also take the form of other types of devices, such as mobile telephones, media players, personal data organizers, handheld game platforms, cameras, and/or combinations of such devices. For instance, the device 10 may be provided in the form of a handheld electronic device that includes various functionalities (such as the ability to take pictures, make telephone calls, access the Internet, communicate via email, record audio and/or video, listen to music, play games, connect to wireless networks, and so forth).

In another embodiment, the electronic device 10 may also be provided in the form of a portable multi-function tablet computing device. In certain embodiments, the tablet computing device may provide the functionality of media player, a web browser, a cellular phone, a gaming platform, a personal data organizer, and so forth.

An embodiment of the invention may be a machine-readable medium having stored thereon instructions which program a processor to perform some or all of the operations described above. A machine-readable medium may include any mechanism for storing or transmitting information in a form readable by a machine (e.g., a computer), such as Compact Disc Read-Only Memory (CD-ROMs), Read-Only Memory (ROMs), Random Access Memory (RAM), and Erasable Programmable Read-Only Memory (EPROM). In other embodiments, some of these operations might be performed by specific hardware components that contain hardwired logic. Those operations might alternatively be performed by any combination of programmable computer components and fixed hardware circuit components. In one embodiment, the machine-readable medium includes instructions stored thereon, which when executed by a processor, causes the processor to perform the method on an electronic device as described above.

In the description, certain terminology is used to describe features of the invention. For example, in certain situations, the terms "component," "unit," "module," and "logic" are representative of hardware and/or software configured to perform one or more functions. For instance, examples of "hardware" include, but are not limited or restricted to an integrated circuit such as a processor (e.g., a digital signal processor, microprocessor, application specific integrated circuit, a micro-controller, etc.). Of course, the hardware may be alternatively implemented as a finite state machine or even combinatorial logic. An example of "software" includes executable code in the form of an application, an applet, a routine or even a series of instructions. The software may be stored in any type of machine-readable medium.

While the invention has been described in terms of several embodiments, those of ordinary skill in the art will recognize that the invention is not limited to the embodiments described, but can be practiced with modification and alteration within the spirit and scope of the appended claims. The description is thus to be regarded as illustrative instead of limiting. There are numerous other variations to different aspects of the invention described above, which in the interest of conciseness have not been provided in detail. Accordingly, other embodiments are within the scope of the claims.

The invention claimed is:

1. An apparatus comprising:

a loudspeaker to output a loudspeaker signal that is based on a reference signal;

a first microphone and a second microphone that are collocated with the loudspeaker to receive at least one of: a near-end speaker signal from a near-end speaker and the loudspeaker signal, and to generate first and second microphone uplink signals, respectively;

a third microphone to receive the near-end speaker signal and to generate a third microphone uplink signal;

a beamformer to receive the first and second microphone uplink signals, to direct a beam towards the loudspeaker and to drive a null towards the near-end speaker and to generate a beamformer output;

a first echo canceller to receive the third microphone uplink signal and the beamformer output, and to generate a first echo estimate;

a second echo canceller to receive the loudspeaker signal and the third uplink microphone signal, and to generate a second echo estimate and to cancel echoes in the third microphone uplink signal based on the loudspeaker signal to generate an echo cancelled signal; and a residual echo suppressor to suppress residual echo in the echo cancelled signal based on the first and second echo estimates.

2. The apparatus of claim 1, wherein the second microphone is closer to the loudspeaker than the first microphone.

3. The apparatus of claim 1, wherein the first and second microphones are located at a bottom of the apparatus, and the third microphone is located at a top area of a front face of the apparatus.

4. The apparatus of claim 1, wherein the first and second microphones are located at a bottom of the apparatus, and the third microphone is located at a top area of a back face of the apparatus.

5. The apparatus of claim 1, wherein the beamformer captures linear and nonlinear components in the loudspeaker signal and removes from the linear and nonlinear components in the loudspeaker signal an interference from the near-end speaker.

6. The apparatus of claim 1, further comprising:

a power estimator that receives a combined echo estimate signal that is a combination of the first and the second echo estimates, and generates a power estimator output that includes estimates for a residual linear echo power and a nonlinear echo power in single and double talk.

7. The apparatus of claim 6, wherein the residual echo suppressor suppresses residual echo in the echo cancelled signal based on the power estimator output.

8. A method comprising:

receiving by a first microphone and a second microphone that are collocated with a loudspeaker at least one of: a near-end speaker signal from a near-end speaker and a loudspeaker signal, wherein the loudspeaker signal is output by the loudspeaker and is based on a reference signal;

generating by the first and second microphones first and second microphone uplink signals, respectively;

receiving by a third microphone the near-end speaker signal;

generating by the third microphone a third microphone uplink signal;

receiving by a beamformer the first and second microphone uplink signals, generating by a beamformer a beamformer output, wherein the beamformer directs a beam towards the loudspeaker and drives a null towards the near-end speaker;

receiving by a first echo canceller the third microphone uplink signal and the beamformer output;

generating by the first echo canceller a first echo estimate;

receiving by a second echo canceller the loudspeaker signal and the third uplink microphone signal;

generating by the second echo canceller a second echo estimate and an echo cancelled signal, wherein the second echo canceller cancel echoes in the third microphone uplink signal based on the loudspeaker signal to generate the echo cancelled signal; and suppressing by a residual echo suppressor residual echo in the echo cancelled signal based on the first and second echo estimates.

9. The method of claim 8, wherein the second microphone is closer to the loudspeaker than the first microphone.

10. The method of claim 8, wherein the first and second microphones are located at a bottom of the apparatus, and the third microphone is located at a top area of a front face of the apparatus.

11. The method of claim 8, wherein the first and second microphones are located at a bottom of the apparatus, and the third microphone is located at a top area of a back face of the apparatus.

12. The method of claim 8, wherein the beamformer captures linear and nonlinear components in the loudspeaker signal and removes from the linear and nonlinear components in the loudspeaker signal an interference from the near-end speaker.

13. The method of claim 8, further comprising:

receiving by a power estimator a combined echo estimate signal that is a combination of the first and the second echo estimates, estimating by the power estimator a residual linear echo power and a nonlinear echo power in single and double talk;

generating by the power estimator a power estimator output that includes estimates of the residual linear echo power and the nonlinear echo power in single and double talk.

14. The method of claim 13, wherein the residual echo suppressor suppresses residual echo in the echo cancelled signal based on the power estimator output.

* * * * *